US010612724B2

(12) United States Patent
Frenal

(10) Patent No.: US 10,612,724 B2
(45) Date of Patent: Apr. 7, 2020

(54) DEVICE FOR SUPPLYING PRESSURISED FLUID

(71) Applicant: L'Air Liquide, Société Anonyme pour l'Etude et l'Exploitation des Procédés Georges Claude, Paris (FR)

(72) Inventor: Antoine Frenal, Ezanville (FR)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 0 days.

(21) Appl. No.: 15/555,389

(22) PCT Filed: Feb. 24, 2016

(86) PCT No.: PCT/FR2016/050428
§ 371 (c)(1),
(2) Date: Sep. 1, 2017

(87) PCT Pub. No.: WO2016/139405
PCT Pub. Date: Sep. 9, 2016

(65) Prior Publication Data

US 2018/0045373 A1 Feb. 15, 2018

(30) Foreign Application Priority Data

Mar. 4, 2015 (FR) ..... 15 51813

(51) Int. Cl.
*F17C 7/00* (2006.01)
*F17C 13/04* (2006.01)

(52) U.S. Cl.
CPC ..... *F17C 13/04* (2013.01); *F17C 7/00* (2013.01); *F17C 2201/0109* (2013.01);
(Continued)

(58) Field of Classification Search
CPC .... F17C 13/04; F17C 7/00; F17C 2201/0109; F17C 2201/056; F17C 2001/058;
(Continued)

(56) References Cited

U.S. PATENT DOCUMENTS 6,557,821 B2 * 5/2003 Girouard ..... F16K 1/302 251/30.01
6,929,028 B2 * 8/2005 Larsen ..... F16K 1/305 137/505.25

(Continued)

FOREIGN PATENT DOCUMENTS

DE 92 17 629 U1 2/1993
DE 101 46 457 4/2003

(Continued)

OTHER PUBLICATIONS

French Search Report and Written Opinion for corresponding FR 1551813, dated Jan. 29, 2016.

(Continued)

*Primary Examiner* — Frederick C Nicolas
(74) *Attorney, Agent, or Firm* — Elwood L. Haynes

(57) ABSTRACT

A device including a tank of pressurized fluid provided with an orifice in which a first valve is fixed that includes a body of elongate overall shape extending along a longitudinal axis (A) between a first end connected to the tank and a second connection end, the device including a protective bonnet for protecting the first valve and delimiting a protective chamber around the first valve, the protective chamber being provided with an access opening the device including a fluid transfer member that forms a separate physical entity from the first valve and from the tank, the transfer member and the first valve including respective coupling members that form a quick-connection system for removably connecting the transfer member to the second end of the valve.

10 Claims, 4 Drawing Sheets

(52) U.S. Cl.
CPC .. *F17C 2201/056* (2013.01); *F17C 2201/058* (2013.01); *F17C 2203/0617* (2013.01); *F17C 2205/0308* (2013.01); *F17C 2205/0329* (2013.01); *F17C 2205/0335* (2013.01); *F17C 2205/0373* (2013.01); *F17C 2205/0385* (2013.01); *F17C 2205/0394* (2013.01); *F17C 2223/0123* (2013.01); *F17C 2223/036* (2013.01); *F17C 2270/0745* (2013.01)

(58) Field of Classification Search
CPC ..... F17C 2203/0617; F17C 2205/0308; F17C 2205/0329; F17C 2205/0335; F17C 2205/0373; F17C 2205/0385; F17C 2205/0394; F17C 2223/0123; F17C 2223/036; F17C 2270/0745
See application file for complete search history.

(56) References Cited

U.S. PATENT DOCUMENTS

| | | | | |
|---|---|---|---|---|
| 8,136,791 | B2 * | 3/2012 | Denis | F17C 13/04 137/320 |
| 8,408,247 | B2 * | 4/2013 | Pisot | F16K 1/306 137/613 |
| 2008/0308181 | A1 | 12/2008 | Denis et al. | |
| 2013/0105037 | A1 | 5/2013 | Frenal et al. | |

FOREIGN PATENT DOCUMENTS

| | | |
|---|---|---|
| EP | 2 116 132 | 11/2009 |
| FR | 2 892 799 | 10/2005 |
| FR | 2 970 313 | 7/2012 |
| FR | 2 979 687 | 3/2013 |
| WO | WO 99 27291 | 6/1999 |
| WO | WO 2012 004483 | 1/2012 |
| WO | WO 2012 015385 | 2/2012 |

* cited by examiner

DEVICE FOR SUPPLYING PRESSURISED FLUID

CROSS REFERENCE TO RELATED APPLICATIONS

This application is a 371 of International PCT Application PCT/FR2016/050428 filed Feb. 24, 2016, which claims priority to French patent Application No. 1551813 filed Mar. 4, 2015, the entire contents of which are incorporated herein by reference.

BACKGROUND

The present invention relates to a device for supplying pressurized fluid.

SUMMARY

The invention relates more particularly to a device for supplying pressurized fluid, notably pressurized gas, comprising a tank of pressurized fluid provided with an orifice in which a first valve is fixed that houses an internal fluid circuit provided with at least one isolation shutter, the first valve comprising a body of elongate overall shape extending along a longitudinal axis between a first end connected to the tank and a second connection end, the device comprising a protective bonnet for protecting the first valve, the bonnet being mounted on the tank and delimiting a protective chamber around the first valve, said protective chamber being provided with an access opening for accessing the second end of the first valve, the device also comprising a fluid transfer member that forms a separate physical entity from the first valve and from the tank, the transfer member comprising an internal circuit for transferring pressurized fluid, the transfer member and said first valve comprising respective coupling members that form a quick-connection system for removably connecting the transfer member to the second end of the valve, in the position in which the transfer member is connected to the first valve, the internal circuit of the transfer member being fluidically connected to the internal circuit of the first valve, at least one of the transfer member and the first valve comprising a locking member for mechanically locking at least one of the coupling members, the locking member being movable and manually actuable between an active position in which it prevents the relative movement of the coupling members so as to prevent the transfer member from being detached from the first valve and an inactive position in which it allows the relative movement of the coupling members in order to allow the transfer member to be detached from the first valve.

The invention relates in particular to a device for distributing fluid, notably pressurized gas, of a modular type. The invention relates notably to the filling of high-pressure gas cylinders (for example at a pressure of between 200 and 700 bar).

Examples of various modular fluid distribution devices are illustrated in the documents FR2892799A1, FR2979687A1 or FR2970313A1.

When these devices use high-pressure fluid (for example at a pressure of 200 bar or above), the safety conditions have to be enhanced so as not to expose the user to high pressures in the event of improper handling.

The documents WO9927291A1 and DE9217629U1 describe quick-connection devices that comprise a safety system which prevents disconnection when the device is pressurized.

The document WO2012004483A1 describes notably a safety device which prevents mechanical disconnection between a filling fitting and a filling connector when the filling fitting is pressurized.

Although satisfactory, the known solutions provide only an imperfect solution to the needs and developments in the ways users use interchangeable modular devices for supplying fluid.

An aim of the present invention is to remedy all or some of the drawbacks of the prior art that are set out above.

To this end, the device according to the invention, which is otherwise in accordance with the generic definition given in the preamble above, is essentially characterized in that, in the position in which the transfer member is connected to the first valve, at least a part of the locking member is housed inside the protective volume delimited by the bonnet.

Furthermore, embodiments of the invention can include one or more of the following features:

- the second end of the first valve has a cylindrical overall shape and the end of the transfer member that is able to be connected to the second end of the first valve has a tubular overall shape, such that the transfer member and the second end of the first valve form female and male elements, respectively, of a quick-connection system for removable connection, and, in the position in which the transfer member is connected to the first valve, at least a part of the transfer member is housed in the bonnet through the opening around the second end of the first valve, the rim delimiting the opening in the bonnet being spaced apart from the end of the transfer member,
- in the position in which the transfer member is connected to the first valve, the rim delimiting the opening in the bonnet is spaced apart from the end of the transfer member by a distance of between 1 mm and 50 mm, and preferably between 1 and 5 mm, in a transverse direction with respect to the longitudinal axis,
- in the position in which the transfer member is connected to the first valve, at least a part of the locking member is disposed between the second end of the first valve and the bonnet,
- in the position in which the transfer member is connected to the first valve, at least a part of the locking member is disposed between the second end of the first valve and the rim delimiting the opening in the bonnet,
- in the position in which the transfer member is connected to the first valve, during its movement from its inactive position to its active position, the locking member moves at least in part towards the inside of the protective volume delimited by the bonnet,
- in the position in which the transfer member is connected to the first valve, during its movement from its active position to its inactive position, the locking member moves at least in part towards the outside of the protective volume delimited by the bonnet,
- in the position in which the transfer member is connected to the first valve, and regardless of its position between active and inactive positions, the locking member has a portion housed in the protective volume delimited by the bonnet,
- the locking member comprises a tubular sleeve which is able to move in translation along a longitudinal axis,
- the coupling members comprise, for the one part, at least one groove and/or at least one rib formed on the outer surface of the second end of the first valve and, for the other part, at least one coupling element mounted on the transfer member so as to be movable between a position referred to as a "spaced-apart" position, allowing the introduction of the connection end of the valve into a central space of the transfer member, and a position referred to as a "moved-together" position, allowing the at least one coupling element to be coupled to the outer face of the connection end of the first valve, the at least one coupling element comprises at least one of a system of movable claw(s) and a system of retractable pin(s) or ball(s), the at least one coupling element comprises at least one movable claw that is disposed around a central space intended to accommodate the connection end of the valve, an internal face of the at least one claw that is situated facing the central space being provided with reliefs and/or recesses and being movable transversely with respect to the central space, the locking member is mounted in a movable manner on the transfer member, the locking member being movable with respect to the coupling element(s) between its active position locking the at least one coupling element in the moved-together position and its inactive position allowing the movement of the at least one coupling element into the spaced-apart position, the locking member is urged into its active position by default by a return member, the transfer member comprises at least one of a second valve and a filling fitting provided for filling fluid into and/or extracting fluid from the tank via the first valve, and the internal circuit of the transfer member comprises a shaft that is able to move in translation and forms a shutter driver that is intended to open the at least one isolation shutter of the first valve by mechanical actuation, in the position in which the transfer member is connected to the first valve, and regardless of its position between active and inactive positions, the locking member has a portion situated outside the protective volume delimited by the bonnet, the transfer member comprises several claws that are spaced apart from one another around a central longitudinal axis, the locking member is disposed about the at least one coupling element, the locking member is in the form of a sleeve and is able to move in translation in a direction parallel to the longitudinal axis, when the at least one coupling element is in the spaced-apart position, a stop prevents the locking member from passing from the inactive position to the active position, and when the at least one coupling element is in the moved-together position, the passage of the locking member from the inactive position to the active position is not impeded by the stop, the device comprises a movable member for selectively spacing apart the claws, said spacing-apart member being movable between a position referred to as a "working" position, preventing the claws from moving from the spaced-apart position to the moved-together position, and a position referred as a "rest" position, allowing the claws to move from the spaced-apart position to the moved-together position, the spacing-apart member preferably being urged into its working position by a return member, the device comprises a stop that is sensitive to the pressure in at least one of the internal circuits in order to lock the coupling members in the connected position and to prevent the disconnection of the transfer member from the first valve when said pressure is greater than a given threshold, the stop being able to move between a first position not locking the coupling members in order that they can be disconnected, and a second position locking the coupling members in order to prevent them from being disconnected, the device comprising a return member that urges the stop into its first position, in its first position, the stop does not interfere with the locking member and, in its second position, the stop mechanically locks the locking member and prevents it from moving from its active position to its inactive position.

The invention can also relate to any alternative device or method comprising any combination of the features above or below.

BRIEF DESCRIPTION OF THE DRAWINGS

Further particular features and advantages will become apparent from reading the following description, given with reference to the figures, in which.

DESCRIPTION OF PREFERRED EMBODIMENTS

Figure 1:
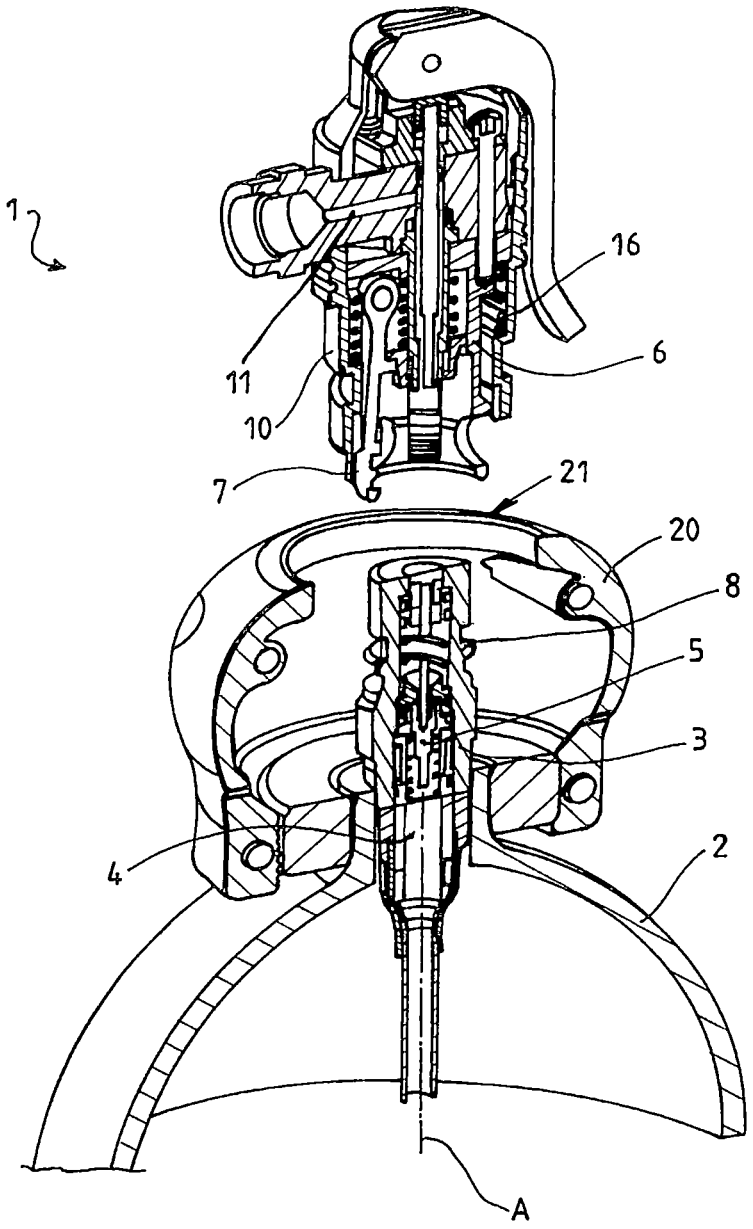
FIG. 1 shows a schematic and partial perspective view in cross section, illustrating an embodiment of a device for supplying fluid in a disconnected state.
Figure 5:
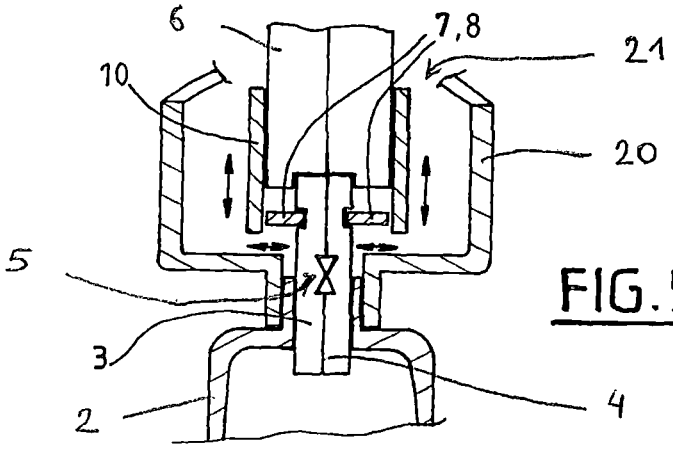
FIG. 5 illustrates a schematic and partial view in vertical cross section, illustrating an example of the structure and functioning of such a device.

The device for supplying pressurized fluid that is shown in FIGS. 1 and 5 comprises a tank 2 of pressurized fluid.

The tank 2 is conventionally provided with an orifice in which a first end of a first valve 3 is fixed (for example by screwing). The first valve 3 comprises a body that houses an internal fluid circuit 4 provided with at least one isolation shutter 5 (and for example several shutters and/or pressure regulators disposed in series or in parallel).

The first valve 3 comprises a body of elongate overall shape, for example of cylindrical shape, extending along a longitudinal axis A between a first end connected to the tank 2 and a second connection end.

The internal circuit 4 leads out for example at two ends of the body of the first valve 3.

The device additionally comprises a protective bonnet 20 for the first valve 3. The bonnet 20 is mounted (fastened rigidly) on the tank 2, for example at a neck of the tank 2 (for example around the portion of the tank 2 that delimits the orifice accommodating the first valve 3). The bonnet 20 delimits a protective chamber around the first valve 3, said protective chamber being provided with an access opening 21 for accessing the second end of the first valve 3.

For example, the bonnet 20 forms a shell disposed concentrically about the first valve, and the opening is centred on the longitudinal axis A of the first valve. The bonnet 20 can be centred and can have a symmetrical shape about the central longitudinal axis A of the first valve 3.

The device for transferring fluid furthermore comprises a fluid transfer member 6 that forms a separate physical entity from the first valve 3 and from the tank 2. The transfer member 6 is for example a second valve and comprises an internal circuit 11 for transferring pressurized fluid.

The transfer member 6 is for example provided to ensure that fluid is extracted from and/or filled into the tank 2 via the first valve 3.

The internal circuit 11 of the transfer member 6 can notably house a shaft 15 that is able to move in translation and forms a shutter driver that is intended to open the shutter(s) 5 of the first valve 3 by mechanical actuation. Notably, the first valve 3 can have, in its internal circuit, a dust protection shutter 22 disposed at the second end of the first valve 3 and an isolation shutter 5 disposed in series further downstream (towards the first end).

The transfer member 6 and said first valve 3 comprise respective mechanical coupling members 7, 8 that form a quick-connection system for removably connecting the transfer member 6 to the second end of the valve 3.

More specifically, in the position in which the transfer member 6 is connected to the first valve 3, the internal circuit 11 of the transfer member 6 is fluidically connected to the internal circuit 4 of the first valve 3 (preferably in a leaktight manner). For example, the shutter driver 15 has a tubular part provided with a system of peripheral seal(s) 25 that provide leaktightness with the end of the internal circuit 4 of the first valve 3 and a part that is able to move in translation in the tubular part in order to actuate the shutter(s). In other words, the fluid can pass through via the inside of the tubular part of the shutter driver 15.

Moreover, at least one of the transfer member 6 and the first valve 3 comprises a locking member 10 for mechanically locking at least one of the coupling members 7, 8. The locking member 10 is movable and manually actuable between an active position in which it prevents the relative movement of the coupling members 7, 8 so as to prevent the transfer member 6 from being detached from the first valve 3 and an inactive position in which it allows the relative movement of the coupling members 7, 8 in order to allow the transfer member 6 to be detached from the first valve 3.

According to one advantageous particular feature, in the position in which the transfer member 6 is connected to the first valve 3, at least a part of the locking member 10 is housed inside the protective volume delimited by the bonnet 20.

In other words, the locking member 10 is at least partly protected by the bonnet 20 when the transfer member 6 is connected to the first valve 3.

However, the locking member 10 remains accessible to a user in and/or outside the bonnet 20.

This makes it possible to protect the locking of the mechanical fastening of the transfer member 6 to the first valve 3 in the event of external impact and also limits the risks of improper handling by a user.

As illustrated in the example in the figures, the end of the transfer member 6 that is connectable to the second end of the first valve 3 preferably has a tubular overall shape, such that the transfer member 6 and the second end of the first valve 3 form female and male elements, respectively, of a quick-connection system for removable connection.

Moreover, in the position in which the transfer member 6 is connected to the first valve 3, at least a part of the transfer member 6 is preferably housed in the bonnet 20 through the opening 21 and around the second end of the first valve 3. The rim delimiting the opening in the bonnet 20 is preferably spaced apart from the end of the transfer member 6 by a distance of for example between 1 mm and 5 cm, for example between 1 mm and 5 mm.

In this way, a region at least where the transfer member 6 is fastened to the first valve 3 is also housed in the protective volume of the bonnet 20. Preferably, at least a part of the mechanical coupling region 7, 8 between the transfer member 6 and the second end of the first valve 3 is likewise housed in the protective volume of the bonnet 20.

This also helps to promote the safety of the device by protecting the coupling members 7, 8 for coupling the transfer member 6 to the first valve 3.

As illustrated in the example in the figures, in the position in which the transfer member 6 is connected to the first valve 3, at least a part of the locking member 10 can be disposed between the second end of the first valve 3 and the bonnet 20. This means that, locally, the bonnet 20 is disposed around the locking member 10, which is itself disposed around the body of the transfer member 6, which is itself disposed around the body of the first valve 3 (cf. FIG. 4).

Moreover, in the position in which the transfer member 6 is connected to the first valve 3, at least a part of the locking member 10 is disposed between the second end of the first valve 3 and the rim delimiting the opening in the bonnet 20. This means that the locking member 10 is accessible manually at the opening in the bonnet 20. In a variant, the movement could be in the opposite direction.

Moreover, in the position in which the transfer member 6 is connected to the first valve 3, during its movement from its inactive position to its active position, the locking member 10 preferably moves at least in part towards the inside of the protective volume delimited by the bonnet 20.

In addition to its ergonomic aspect, this movement enhances the protection of the locking.

Moreover, in the position in which the transfer member 6 is connected to the first valve 3, during its movement from its active position to its inactive position, the locking member 10 is preferably moved at least in part towards the outside of the protective volume delimited by the bonnet 20. In a variant, this movement could be in the opposite direction. This means that the movement of the member 10 for unlocking the mechanical connection between the first valve 3 and the transfer member 6 preferably tends to at least partially withdraw the locking member 10 from the volume of the bonnet 20.

In the connected position, at least in the active position or in the inactive position, the locking member 10 has a position housed in the protective volume delimited by the bonnet and a position situated outside the protective volume delimited by the bonnet.

Likewise preferably, in the position in which the transfer member 6 is connected to the first valve 3, and regardless of its position between active and inactive positions, the locking member 10 has a portion housed in the protective volume delimited by the bonnet 20 and optionally a portion situated outside the protective volume delimited by the bonnet 20. This makes it possible both to ensure mechanical protection of the mechanism and to make the locking member 10 easily accessible. Of course, it is possible to provide a variant in which the member 10 is completely outside the protective volume of the bonnet 20 when it is disposed in its inactive position.

In the non-limiting exemplary embodiment in the figures, the locking member 10 comprises a tubular sleeve that is able to move in translation on the body of the transfer member 6 along a longitudinal axis. More specifically, in the position connected to the first valve, the locking sleeve 10 can be moved in translation along (about) the central longitudinal axis A of the first valve 3.

The sleeve 10 thus slides around the body of the transfer member 6 and therefore around the second end of the first valve 3.

Moreover, in the example shown in the figures, the coupling members 7, 8 comprise, for the one part, at least one groove and/or at least one rib 8 formed on the outer surface of the second end of the first valve 3 and, for the other part, at least one coupling element 7 mounted in a movable manner on the transfer member 6. The geometries (dimensions, positions) of the coupling members 7, 8 are complementary and preferably exclusive so as to form a coupling system which prevents the connection of a third-party member that does not have the same geometrical features.

In other words, the connection system comprises a locking function (that is to say a mechanical coupling function) and a poka-yoke feature (that is to say a male/female system which only allows a fitting of given geometry to be connected to a connector of a given type in order to avoid dangerous connections).

The coupling member 7 is movable between a position referred to as a "spaced-apart" position, allowing the introduction of the connection end of the valve 3 into a central space of the transfer member 6, and a position referred to as a "moved-together" position, allowing the at least one coupling element 7 to be coupled to the outer face of the connection end of the first valve 3.

In the example shown in FIGS. 1 to 4, the at least one coupling element 7 comprises at least one system of movable claws 7. Of course, the claws 7 could be replaced by a system of retractable pins or balls that are well known in quick-connection systems.

The coupling element comprises at least one and preferably several movable claws 7 (two, three, four, etc.) disposed around a central space intended to accommodate the connection end of the valve 3. An internal face of the claws 7 that is situated facing the central space is provided with reliefs and/or recesses that are complementary to the outer shape of the first valve 3. The claws 7 are movable transversely with respect to the central space (cf. FIGS. 3 and 4).

Figure 2:
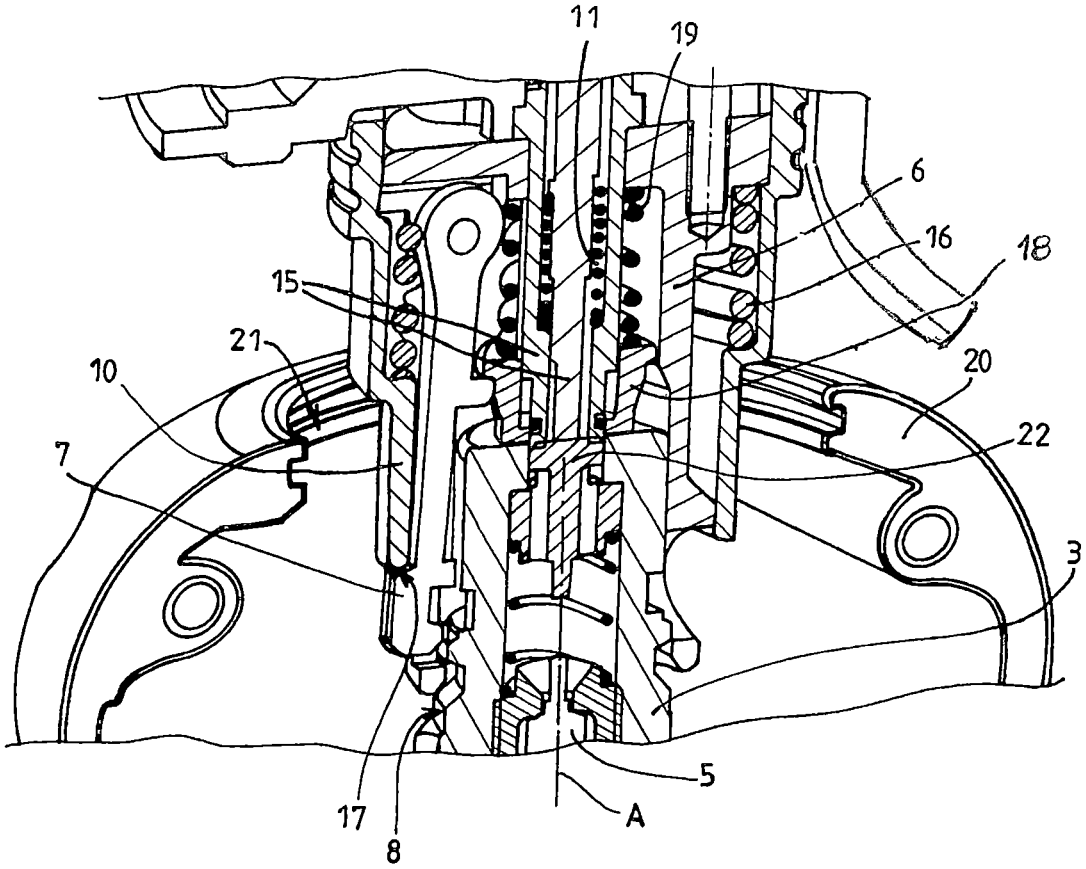
FIG. 2 shows a schematic and partial perspective view in cross section of an enlarged detail of the device in FIG. 1, illustrating one of three successive steps in the passage from the disconnected state to a connected state.
Figure 3:
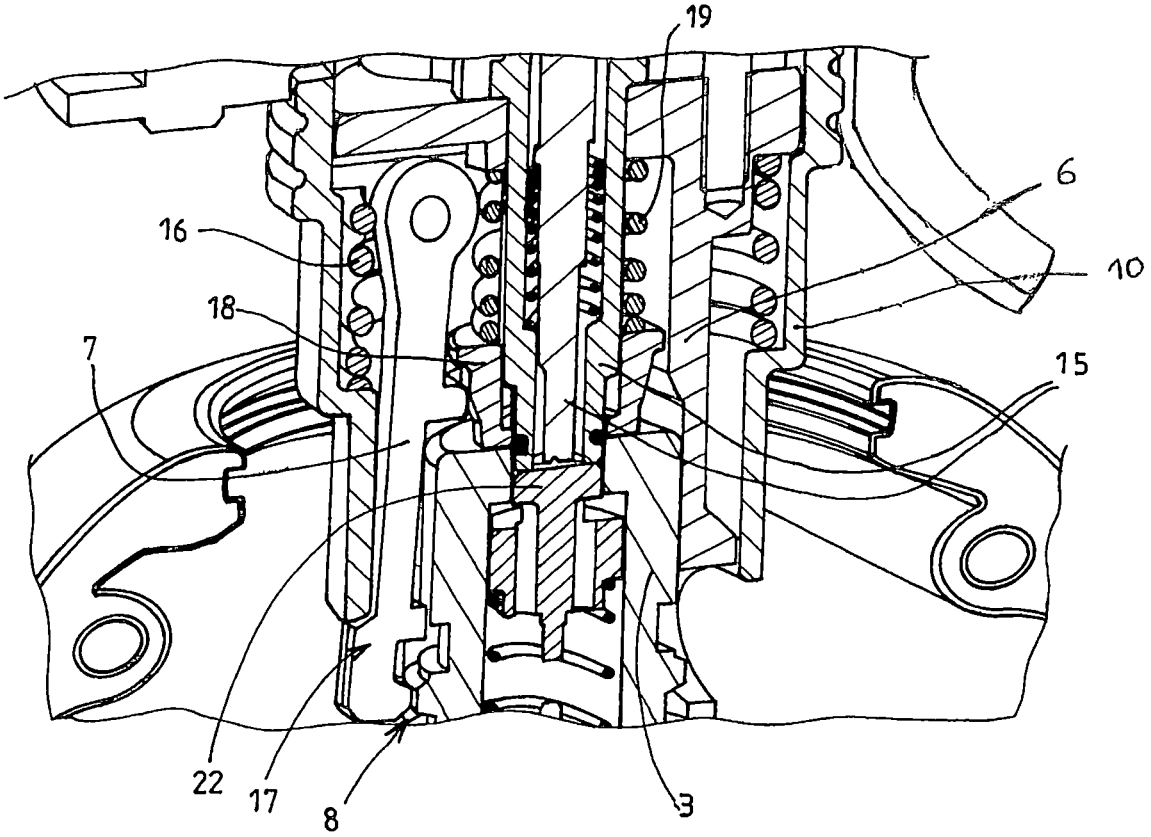
FIG. 3 shows a schematic and partial perspective view in cross section of an enlarged detail of the device in FIG. 1, illustrating one of three successive steps in the passage from the disconnected state to a connected state.

As can be seen in FIG. 2, the claws 7 are in the spaced-apart position, and the transfer member 6 can be threaded onto the second end of the first valve 3. A stop 17 formed on the claw(s) 7 can prevent the locking sleeve 10 from passing from the inactive position to the active position in spite of the force of the spring 16.

Figure 4:
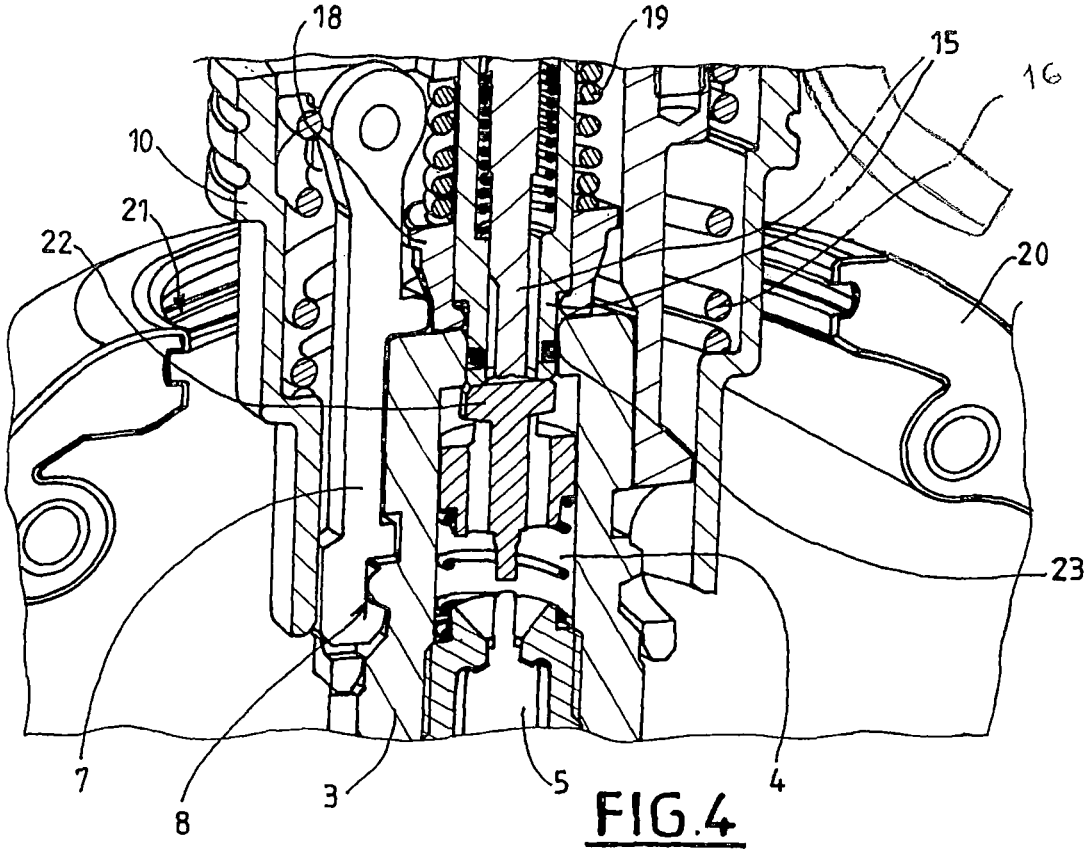
FIG. 4 shows a schematic and partial perspective view in cross section of an enlarged detail of the device in FIG. 1, illustrating one of three successive steps in the passage from the disconnected state to a connected state.

The transfer member 6 can comprise a movable member 18 for selectively spacing apart the claws 7. The spacing-apart member 18 may be movable between a position referred to as a "working" position, preventing the claws 7 from moving from the spaced-apart position to the moved-together position (cf. FIGS. 2 and 3), and a position referred as a "rest" position, allowing the claws 7 to move from the spaced-apart position to the moved-together position (FIG. 4). The spacing-apart member 18 is preferably urged into its working position by a return member 19.

For example, by lowering the transfer member 6 onto the first valve, the locking of the claws 7 in the spaced-apart position is suppressed (the spacing-apart member 18 is pushed back).

The claws 7 are urged into their moved-together position by the locking sleeve 10. It is possible for the claws 7 to be moved together when the latter are next to the shape 8 corresponding thereto on the first valve 3. By hinging inwards, the claws 7 no longer form an obstacle to the movement of the locking sleeve 10 into the active position. The sleeve 10 is thus lowered in the bonnet 20, covering and locking the claws 7 in their housing 8 on the first valve 3. Coupling takes place in a semi-automatic manner. The mechanical connection is started manually by the operator and final snap-fastening and locking are obtained by the return members 16, which urge the locking sleeve 10 into its locking position locking the connection between the coupling members 7, 8.

In this active position, the sleeve 10 grips the claws 7 in the moved-together position. In other words, the sleeve 10 forms a mechanical stop that prevents the claws 7 from moving apart.

In order to detach the transfer member 6, the user has to move the locking sleeve 10 into the inactive position (upwards in the figures, in the direction of its removal from the bonnet) in order to uncover the claws 7 and allow them to move apart from their coupling region 8 in which they are coupled to the first valve 3.

The structure and functioning of the device provide a high level of reliability and safety with respect to impacts or improper handling.

The invention also relates to a method for connecting the transfer member 6 to the first valve 3 and/or, respectively, a method for separating the transfer member from the first valve 3, in which the locking member 10 is actuated and moved from its inactive position to its active position, or, respectively, from its active position to its inactive position. In particular, in order to connect the transfer member 6 to the first valve, the locking member 10 can be disposed or held in its inactive position in order to allow the coupling members 7, 8 of the transfer member 6 and of the first valve 3 to engage (for example by snap-fastening and/or coupling).

Next, the locking member is moved automatically and/or manually into its active position.

Conversely, when the transfer member 6 is connected to the first valve (coupling members 7, 8 are coupled and locked by the locking member 10 in the active position), in order to separate the transfer member 6 from the first valve 3, the locking member 10 is moved from its active position to its inactive position (manually, for example). The coupling members 7, 8 can be moved relative to one another in order to allow the two assemblies to be separated.

According to possible particular features:

- the locking member is moved manually and/or automatically pneumatically, hydraulically or electromechanically,
- the locking member is moved manually by gripping at least one part of the locking member that is situated outside the protective volume of the bonnet.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

The invention claimed is:

1. A device for supplying pressurized fluid, comprising a tank of pressurized fluid provided with an orifice in which a first valve is fixed that houses an internal fluid circuit provided with at least one isolation shutter, the first valve comprising a body of elongate overall shape extending along a longitudinal axis (A) between a first end connected to the tank and a second connection end, the device comprising a protective bonnet for protecting the first valve, the bonnet being mounted on the tank and delimiting a protective chamber around the first valve, said protective chamber being provided with an access opening for accessing the second end of the first valve, the device also comprising a fluid transfer member that forms a separate physical entity from the first valve and from the tank, the transfer member comprising an internal circuit for transferring pressurized fluid, the transfer member and said first valve comprising respective coupling members that form a quick-connection system for removably connecting the transfer member to the second end of the valve and have a relative movement, in a position in which the transfer member is connected to the first valve, the internal circuit of the transfer member being fluidically connected to the internal circuit of the first valve, at least one of the transfer member and the first valve comprising a locking member for mechanically locking at least one of the coupling members, the locking member being movable and manually actuable between an active position preventing the relative movement of the coupling members so as to prevent the transfer member from being detached from the first valve and an inactive position allowing the relative movement of the coupling members in order to allow the transfer member to be detached from the first valve, wherein, in the position in which the transfer member is connected to the first valve, only a part of the locking member is housed inside the protective volume delimited by the bonnet, and in that the locking member is manually accessible for a user at the outside of the bonnet, wherein the second end of the first valve has a cylindrical overall shape and an end of the transfer member that is configured to be connected to the second end of the first valve has a tubular overall shape, such that the transfer member and the second end of the first valve form female and male elements, respectively, of a quick-connection system for removable connection, and in that, in the position in which the transfer member is connected to the first valve, at least a part of the transfer member is housed in the bonnet through the opening around the second end of the first valve, a rim delimiting the opening in the bonnet being spaced apart from the end of the transfer member.

2. The device according to claim 1, wherein, in the position in which the transfer member is connected to the first valve, the rim delimiting the opening in the bonnet is spaced apart from the end of the transfer member by a distance of between 1 mm and 50 mm in a transverse direction with respect to the longitudinal axis (A).

3. The device according to claim 1, wherein in the position in which the transfer member is connected to the first valve, at least a part of the locking member is disposed between the second end of the first valve and the bonnet.

4. The device according to claim 1, wherein in the position in which the transfer member is connected to the first valve, at least a part of the locking member is disposed between the second end of the first valve and the rim delimiting the opening in the bonnet.

5. The device according to claim 1, wherein in the position in which the transfer member is connected to the first valve, during the movement from the inactive position to the active position, the locking member moves at least in part towards the inside or, respectively, towards the outside of the protective volume delimited by the bonnet.

6. The device according to claim 1, wherein in the position in which the transfer member is connected to the first valve, during the movement from the active position to the inactive position, the locking member moves at least in part towards the outside or, respectively, towards the inside of the protective volume delimited by the bonnet.

7. The device according to claim 1, wherein in the position in which the transfer member is connected to the first valve, and the locking member has a portion housed in the protective volume delimited by the bonnet.

8. The device according to claim 1, wherein the locking member comprises a tubular sleeve which is configured to move in translation along a longitudinal axis and which is parallel to the longitudinal axis of the first valve in the connected position.

9. The device according claim 1, wherein the transfer member comprises at least one of a second valve, a filling fitting provided for filling fluid into and/or extracting fluid from the tank via the first valve, the internal circuit of the transfer member comprises a shaft that is configured to move in translation and forms a shutter driver that is configured to open the at least one isolation shutter of the first valve by mechanical actuation.

10. A method for connecting or separating, the transfer member to or from the first valve of the device for supplying pressurized fluid according claim 1, further comprising an operation of moving the locking member from the inactive position to the active position or from the active position to the inactive position, respectively.

* * * * *